United States Patent [19]

Keyes et al.

[11] Patent Number: 4,509,041

[45] Date of Patent: Apr. 2, 1985

[54] CORRELATION TYPE FLICKER FLAMON

[75] Inventors: Marion A. Keyes, Chagrin Falls; William L. Thompson, Chardon, both of Ohio

[73] Assignee: The Babcock & Wilcox Company, New Orleans, La.

[21] Appl. No.: 360,861

[22] Filed: Mar. 22, 1982

[51] Int. Cl.[3] ..... G08B 17/12; G08B 21/00

[52] U.S. Cl. ..... 340/578

[58] Field of Search ..... 340/578

[56] References Cited

U.S. PATENT DOCUMENTS

| | | | |
|---|---|---|---|
| 3,146,822 | 9/1964 | Ray | 340/578 X |
| 3,586,468 | 6/1971 | Sims et al. | 431/75 X |
| 3,651,327 | 3/1972 | Thomson | 340/578 X |
| 3,772,670 | 11/1973 | Swithenbank et al. | 340/578 X |
| 3,988,104 | 10/1976 | Barber | 431/90 |
| 4,157,506 | 6/1979 | Spencer | 328/1 X |
| 4,280,184 | 7/1981 | Weiner et al. | 340/578 X |

FOREIGN PATENT DOCUMENTS

| | | | |
|---|---|---|---|
| 748016 | 12/1966 | Canada | 340/578 |
| 932298 | 7/1963 | United Kingdom | 340/578 |

OTHER PUBLICATIONS

"CD4049UB, C94050B Types COS/MOS Hex Buffer/-Converters Features", p. 194, (an undated description of a prior art Lex inverter).

CD4070B CD4077B Types COS/MOS Quad Exclusive-OR and Exclusive-NOR Gates Features", p. 235, (an undated description of a prior art RCA Exclusive or Gate).

*Primary Examiner*—Stephen A. Kreitman
*Assistant Examiner*—Thomas P. Noland
*Attorney, Agent, or Firm*—Vytas R. Matas; Robert J. Edwards

[57] ABSTRACT

A device and method is disclosed which determines the presence and absence of a burner flame by injecting a pressure modulated signal into the burner which modulates a flame at a selected frequency. Light emitted from the flame is modulated at the same frequency. An optical sensor is provided for sensing the light amplitude modulation frequency and connected to a correlator circuit for correlating the light amplitude modulation signal with the pressure modulation signal. If the signals correlate, a flame is assumed to be present and a flame on signal generated. The pressure modulation signal can be discontinued periodically. If a corresponding discontinuation of the light amplitude modulation signal is sensed this is indicative of the continued presence of the flame whereas a continuation of the light amplitude modulation signal indicates a flame out condition.

4 Claims, 6 Drawing Figures

FIG. 2
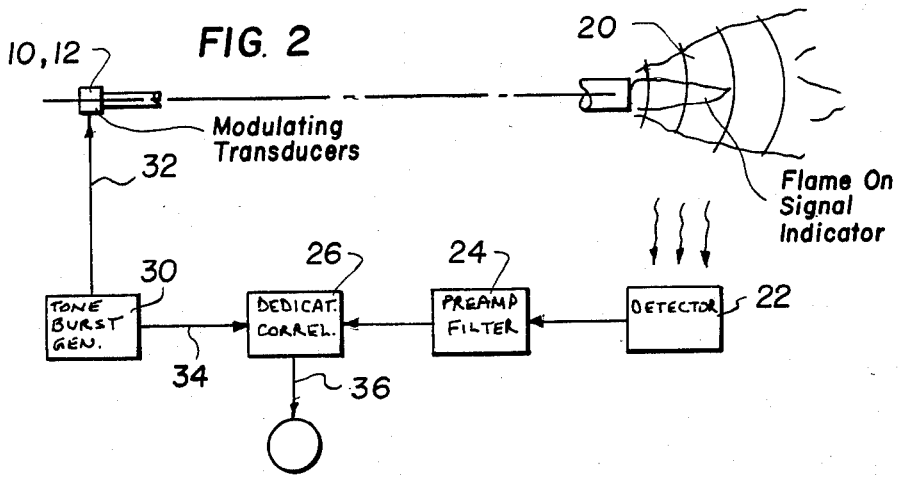
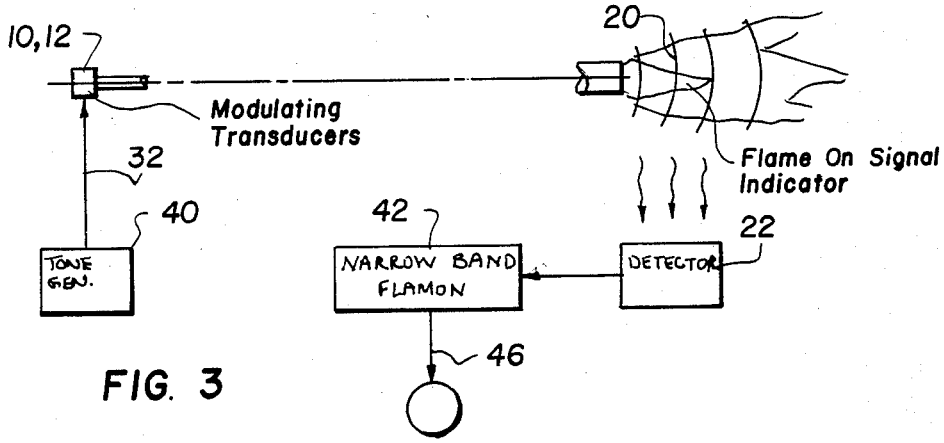
FIG. 3
FIG. 6
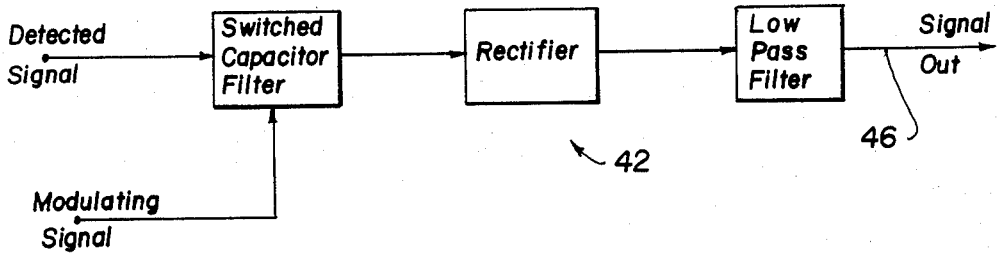

CORRELATION TYPE FLICKER FLAMON

FIELD AND BACKGROUND OF THE INVENTION

The present invention relates in general to flamon devices and in particular to a new and useful device and method of determining whether a burner flame is in an on condition, in particular a coal fired burner flame.

Equipment is known for remotely sensing whether a flame of a burner is on or not. So called flicker flamon units have been disclosed which sense the flicker frequencies that occur naturally in burner flames. In such devices, however, each burner must be analyzed to determine the optimum frequency band for that burner. It often happens that adjacent burners have similar flicker frequencies so that it becomes difficult for a remote sensor to determine whether the one or the other of the burners are on.

It is also known for the purposes of discovering the state of a burner flame, to propagate cyclic pressure waves through a burner which waves produce cyclic oscillations in the flame. Such oscillations have been discovered to produce electromagnetic variations which can be sensed using a radio antenna, as disclosed in U.S. Pat. No. 3,586,468 to Sims.

Other techniques and apparatus for sensing the presence of a burner flame are disclosed in U.S. Pat. No. 2,979,125 to Katorsky, and U.S. Pat. No. 2,460,314 to Thomson.

SUMMARY OF THE INVENTION

The present invention provides for flamon sensing of a plurality of burners by injecting a specific and different frequency into each burner then sensing the flame for that frequency. Each burner is thus provided with a unique signature which if missing indicates the absence of a flame from that burner. Discrimination is thus provided for adjacent burners.

Accordingly, an object of the invention is to provide an apparatus and method of determining the presence of a burner flame comprising, modulation means connected to the burner for modulating a burner flow pressure at a selected frequency to modulate a light amplitude of the burner flame, an optical flicker detector for detecting the light amplitude of the burner flame and generating a light amplitude signal which varies with variations in the light amplitude of the burner flame, and correlation means connected to the optical flicker detector for establishing correlation between the selected frequency and a frequency of the light amplitude variations to generate a flame on signal with such correlation only.

A further object of the invention is to provide such a device and method wherein the burner is a pulverized coal burner and the selected frequency is in the range of about 10 to 500 Hz.

A further object of the invention is to provide such a device which is simple in design, rugged in construction and economical to manufacture.

The various features of novelty which characterize the invention are pointed out with particularity in the claims annexed to and forming a part of this disclosure. For a better understanding of the invention, its operating advantages and specific object attained by its uses, reference is made to the accompanying drawings and descriptive matter in which preferred embodiments of the invention are illustrated.

BRIEF DESCRIPTION OF THE DRAWINGS

In the drawings:

FIG. 2 is a block diagram of the circuitry for one embodiment of the invention;

FIG. 3 is a block diagram of circuitry for another embodiment of the invention;

FIGS. 5 and 6 are block diagrams showing a tone burst generator and digital filtering circuits of the invention.

DESCRIPTION OF THE PREFERRED EMBODIMENTS

Figure 1:
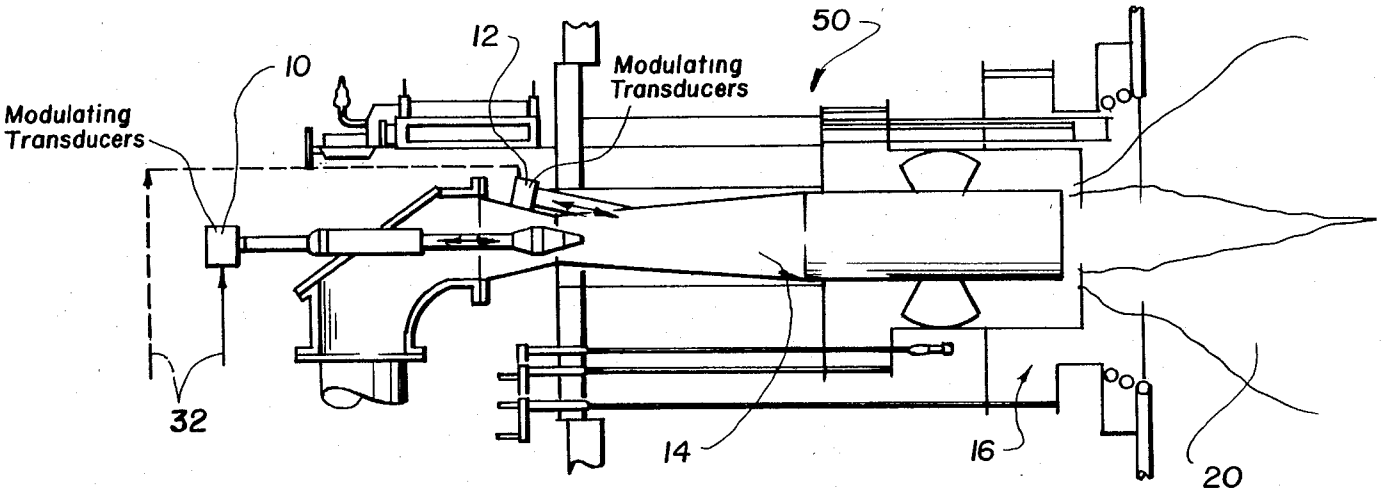
FIG. 1 is a side sectional view of a coal fired burner with modulating transducers shown at two possible locations either or both of which can be used in accordance with the invention.

Referring to the drawings in particular, the invention embodied therein in FIG. 1 comprises a correlation type flicker flamon for a burner generally designated 50, which is particularly suited to be coal fired using a pulverized coal and air mixture.

Modulation means in the form of a transducer 10 or a transducer 12 are provided for modulating the pressure of the fuel mixture in a mixing chamber 14 of the burner. The transducers may be a diaphragm, a piston, a rotating shuttle valve, or a piezo electric element. It is also possible to provide a magnetostrictive transducer in the air injection line of the device shown at 16.

For a pulverized coal fired burner the preferred frequency range of the pressure modulation is between about 10 and 500 Hz. With the pressure of the flow in mixing chamber 14 thus modulated, the amplitude of the light from flame 20 is also modulated.

As shown in FIG. 2, the light amplitude modulation can be picked up by a photocell in the form of an optical flicker detector 22, which generates a light amplitude signal that is amplified and filtered in a preamp 24 and supplied to a correlator 26. A tone burst generator 30 generates a transducer operating signal at the selected frequency which is applied to the transducer over a line 32. The same or a similar signal at the same selected frequency is supplied over a line 34 to the correlator. The correlator functions to correlate the frequency of the light amplitude signal coming from preamp 24 and the selected frequency signal coming from line 34. If such correlation is sensed then a flame on signal is provided over line 36. This signal is indicative of the presence of a flame. If the flame were to disappear, no correlation would exist since no appropriate light amplitude signal would be provided from preamp 24. A flame off signal or no signal is then provided over line 36 to indicate the absence of a flame.

Since where multiple burners are used, each burner is provided with its own selected frequency, the presence of amplitude modulated light at different frequencies does not affect the detection of the light amplitude signal for the particular burner. The presence or absence of a flame from any of the burners can thus be determined regardless of their close proximity.

Periodically another test can be made to confirm the presence of a flame. This test comprises the discontinuation of the selected frequency signal for a short time. Such discontinuation must be accompanied by a corresponding discontinuation of the light amplitude signal from preamp 24. If there is no such discontinuation it is assumed that the flame is no longer present and an appropriate signal is provided over line 36. The selected frequency signal is thus provided in burst according to the embodiment in FIG. 2.

According to the embodiment of FIG. 3, a continuous signal is provided from a tone generator 40 to the appropriate transducer. The light amplitude signal from photocell 22 is provided to a narrow band flamon circuit 42 which internally includes the selected frequency of the tone generator 40 and, as with the embodiment of FIG. 2, provides a flame on signal overlying 46 where correlation is sensed between the light amplitude modulation signal and a signal at the selected frequency of the tone generator.

The signals thus received by the correlator, lock, sense and correlate peak amplitudes of both signals to be used in the determination of the presence or absence of positive correlation and hence the presence or absence of a flame in the burner. The correlation technique rejects signals that do not correlate but are at the same frequency.

Figure 4:
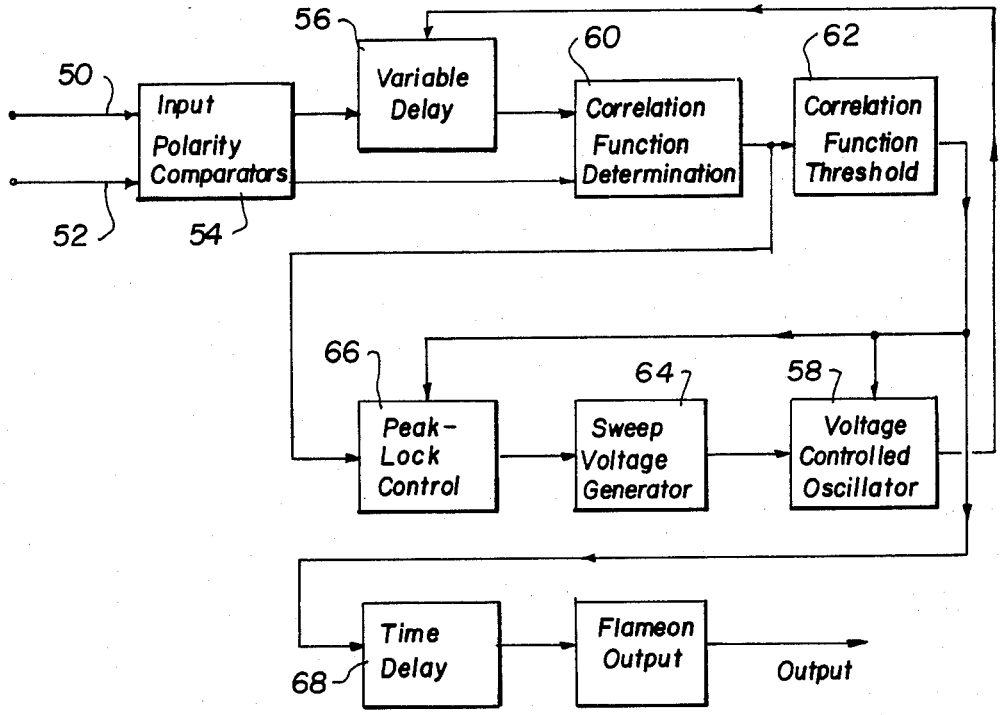
FIG. 4 is a block diagram showing details of the correlator.
Figure 5:
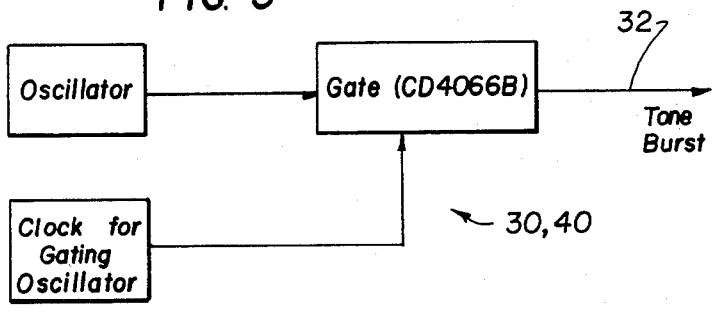

Referring to FIGS. 4–6, details of the inventive circuitry are disclosed.

The signal injected into the burner is typically a burst of a sine or square wave or other convenient waveform. This signal is used to control the pressure or flow into the burner. The tone burst is generated by circuitry shown in FIG. 5. An oscillator generates a sine or square wave or other conventient waveform at the desired frequency for modulation. This wave is then gated at a lower frequency than the wave itself and the resultant gated or tone-burst waveform is used to control the input signal to the burner.

A signal occurring in the flow in the burner may alternately be measured by a pressure or flow sensor and correlated with a corresponding signal in the optical signal from the flame, provided by detector 22. This signal is characteristic of the individual burner when properly sensed and may be used for a correlation to detect the presence of flame at the instrumented burner.

The optical signal detected from the flame is processed in conjunction with the signal modulating the flame in a dedicated correlator (FIG. 4).

Referring to FIG. 4, the input signals from the filter 24 and the generator 30 are converted to square waves corresponding to their polarity or sign, over lines 50 and 52. A comparator 54 operates on each signal giving a high level when the input is above zero (or positive polarity) and a low level when the input is below zero (or negative polarity).

Variable delay is provided by 256 bits of a digital shift register which are used to provide 256 units of delay to the signal from one of the input comparators 54, over variable delay 56.

The clock for the shift register is generated by a VCO (voltage-controlled-oscillator 58).

In the correlation function detector 60, the value of the correlation function, for the delay determined by the shift register and its clock, is typically determined by averaging the time that the two signals are of like polarity. This may be effected by acting on the two signals, one delayed and one not, by an exclusive OR. This gives a signal that is high when the two are unequal and low when they are equal. An inverter is added to give high when equal. An R-C filter averages the "equals" and "not equals" giving the value of the correlation function for the given delay.

Relative correlation peaks, other than the main one, can occur in the signal due to the character of the signals. The correlation function threshold circuit 62 is set to allow only action on the single main peak. This eliminates the false locking possibility.

In sweep voltage generator 64, a slow sawtooth voltage is generated to control the frequency of the clock for the shift register. This effects a search for the correlation peak when the circuit is not locked to the peak. When the peak is located the direction of the sawtooth waveform is changed to keep the variable delay moving back and forth "over" the correlation peak.

The rate of the sawtooth has two values, slow and fast. The slow is used in tracking the peak (when the peak is locked in) and the fast is used to find the peak (to get over the correlation function threshold). The slow/-fast feature is controlled by the Correlation Function Threshold circuit. The change in direction is controlled by the Peak-Lock Control.

The peak-lock control 66 determines when the correlator is going away from the peak (value of correlation function is decreasing) and issues a command to the sweep voltage generator to change direction. This reverses the direction of change of the delay and moves back up the correlation function. The circuit, when in lock, then travels back and forth over the correlation peak.

The correlation function amplitude is sampled and stored. It is again sampled at a short time later. The two samples are compared. If they are within a predetermined voltage of each other they are judged "equal". In this case, the second sampler is activated again. This continues until the second sample is either higher or lower than the original stored value. If the value of the latest sample is higher than the stored value, the cycle begins again with an updated stored value and later samples for comparison with it. If, however, the value of the latest sample is lower than the stored value a judgment is made that the circuit is moving away from the peak and a change-direction command is issued to the sweep voltage generator.

The peak-lock control circuit 66 is inoperative when the correlation function threshold criteria isn't satisfied.

An integrated circuit function generator is used as a voltage controlled oscillator 58. This provides a swept frequency as clock signal for the variable delay circuit 56. The frequency of this oscillator is controlled by the output of the sweep voltage generator.

The output of the correlation function threshold detector 62 is also an indication of the presence of a flame. When the signal introduced into the burner is found in the brightness signal from the flame by the correlation circuit there is positive evidence that the flame being sensed is associated with that burner. A delay is used typically following this threshold signal 68 to eliminate spurious flameoff signals.

FIG. 6 shows a signal processor utilizing a receiving filter tuned to the modulating signal. This filter will pass only the frequency being transmitted and as such will on the average, only see a signal directly obtained from the modulating signal. The presence of substantial signal in the filter's output indicates a flame arising from the burner being modulated. The filter is typically implemented by a switched-capacitor filter such as a Reticon type 5610. Additional assurance is obtained by gating the transmitted signal off and on at a slow rate and observing the output of the receiving circuit to determine it, after an appropriate delay, whether the same pattern is present in the detected signal.

While specific embodiments of the invention have been shown and described in detail to illustrate the application of the principles of the invention, it will be understood that the invention may be embodied otherwise without departing from such principles.

What is claimed is:

1. A device for continuously determining the presence of a flame emitted from a burner comprising:

modulation means connected to the burner for modulating a burner flow pressure at a selected frequency to modulate a light amplitude of the burner flame;

an optical flicker detector associated with the burner for detecting variations in the light amplitude of the burner flame and generating a light amplitude modulation signal which varies with variations in the light amplitude of the flame;

correlator means connected to said optical flicker detector for generating a flame on signal when correlation is established between the selected frequency of said modulation means and said light amplitude modulation signal; and said modulation means comprising a tone burst generator for modulating the burner flow pressure at said selected frequency in bursts with said correlator means being operable to detect the termination of each burst and detect a corresponding termination in said light amplitude modulation signal to maintain said flame on signal.

2. A device according to claim 1, wherein the burner is adapted for pulverized coal firing, said modulation means modulating the burner flow pressure at a selected frequency of between about 10 and 500 Hz.

3. A method of continuously determining the presence of a flame emitted from a burner comprising:

pressure modulating the burner with a tone burst generator to produce amplitude modulations in the light of the flame;

optically sensing the light of the flame to generate a light amplitude signal;

comparing the light amplitude signal with the pressure modulation of the flame to determine a correlation thereof;

generating a flame on signal indicative of the presence of a flame with the occurrence of said correlation;

periodically discontinuing said pressure modulation;

detecting a discontinuation of said light amplitude modulation; and with said discontinuation of said light amplitude modulation maintaining said flame on signal.

4. A method according to claim 3, including providing said pressure modulation at a frequency of about 10 to 500 Hz.

* * * * *